US006435630B1

(12) United States Patent
Anin et al.

(10) Patent No.: US 6,435,630 B1
(45) Date of Patent: Aug. 20, 2002

(54) CLIMATIC CONDITION REPRODUCER CABINET

(75) Inventors: Marc Anin, Ustaritz; Lionel Vasseur, Hendaye; Jean-Michel Jorland, Saint Pees/Nivelle; Eric Villeminot, Chateau-Thierry, all of (FR)

(73) Assignees: Bonnet-Neve, Chatou; SOVIS, Chateau-Thierry, both of (FR)

( * ) Notice: Subject to any disclaimer, the term of this patent is extended or adjusted under 35 U.S.C. 154(b) by 0 days.

(21) Appl. No.: 09/446,106

(22) PCT Filed: Apr. 20, 1999

(86) PCT No.: PCT/FR99/00929

§ 371 (c)(1),
(2), (4) Date: Apr. 25, 2000

(87) PCT Pub. No.: WO99/55204

PCT Pub. Date: Nov. 4, 1999

(30) Foreign Application Priority Data

Apr. 23, 1998 (FR) ..... 98 05078

(51) Int. Cl.[7] ..... A47F 3/04; E04C 2/54
(52) U.S. Cl. ..... 312/116; 312/296; 52/786.13
(58) Field of Search ..... 312/116, 138.1, 312/109, 405, 296; 49/366, 367, 368; 52/788.1, 786.1, 786.13

(56) References Cited

U.S. PATENT DOCUMENTS

| | | | | | |
|---|---|---|---|---|---|
| 3,259,446 | A | * | 7/1966 | Harle et al. | 312/296 |
| 3,331,159 | A | * | 7/1967 | Cooke et al. | 312/296 X |
| 3,631,630 | A | * | 1/1972 | Buffington | 49/402 |
| 3,822,506 | A | * | 7/1974 | Fishbach | 49/367 |
| 4,429,493 | A | * | 2/1984 | St. Aubin | 49/367 |
| 4,818,043 | A | * | 4/1989 | Borgen | 312/116 X |
| 4,977,754 | A | * | 12/1990 | Upton et al. | 312/116 X |
| 5,270,084 | A | * | 12/1993 | Parker | 52/786.13 X |
| 5,329,736 | A | * | 7/1994 | Sodervall | 312/116 X |
| 5,363,611 | A | * | 11/1994 | Richardson et al. | 312/116 |
| 6,052,965 | A | * | 4/2000 | Florentin et al. | 52/786.13 |

FOREIGN PATENT DOCUMENTS

| | | |
|---|---|---|
| EP | 38015 | * 10/1981 |
| EP | 674865 | * 10/1995 |

* cited by examiner

*Primary Examiner*—James O. Hansen
(74) *Attorney, Agent, or Firm*—Oblon, Spivak, McClelland, Maier & Neustadt, P.C.

(57) ABSTRACT

An environmental cabinet including at least two opening leaves which have an insulating glazing unit composed of at least two glass sheets between which a vacuum has been created. The sheets are joined together around their periphery by an inorganic seal. The sealing between the two opening leaves is achieved by a vertical member which overlaps the edges of both opening leaves and is fixed to one of the edges.

15 Claims, 4 Drawing Sheets

CLIMATIC CONDITION REPRODUCER CABINET

BACKGROUND OF THE INVENTION

1. Field of the Invention

The invention relates to an environmental cabinet comprising at least one opening leaf consisting of an insulating glazing unit composed of at least two glass sheets between which a vacuum has been created, the said sheets being joined together by an inorganic seal.

The invention will be more particularly described in the case of a refrigerated cabinet in which fresh, chilled or deep-frozen products are displayed, the usual name for which is a "refrigerated display cabinet", but the invention is not limited to this type of cabinet, any cabinet with a hot, wet or dry environment also falling within the scope of the invention.

2. Discussion of the Background

When products preserved in a refrigerated chamber have to remain visible, as is the case in many current commercial premises, the refrigerated chamber is equipped with glazed parts which convert it into a refrigerated display cabinet. There are many variants of such refrigerated display cabinets. Some are in the form of upright cabinets, and then it is the door itself which is transparent, others are in the form of chests, and it is the horizontal lid which is glazed in order to allow the contents to be seen, while yet others are in the form of display counters, and it is that part which separates the public from the merchandise that is glazed. Whatever the variant of these refrigerated display cabinets, it is also possible to produce glazed walls so that the entire contents are visible from the outside.

The invention will be more particularly described in the case of refrigerated display cabinets in the form of an upright cabinet, but the invention is not limited to this type of cabinet.

In this type of display cabinet, it is necessary for the merchandise to remain completely visible to the customers so that it is possible to preselect the merchandise without opening the cabinet. Consequently, it is necessary to prevent the glazed parts of the cabinet from being covered with condensation.

To avoid condensation, the method used consists generally in maintaining that surface of the glazing unit facing the controlled environment at a temperature above the dew point of the atmosphere in question. This objective is achieved by increasing the insulation performance of the glazing unit and sometimes, in addition, heating the surface of the side in question. The simplest means of improving the thermal insulation performance of a single-glazing unit consists in replacing it with a multiple-glazing unit. This technique is easy to employ in the case of refrigerated chests or upright cabinets since multiple-glazing units, consisting of two flat glass sheets mounted so as to be parallel to each other and separated by a gas layer, are easily fitted to this type of refrigerated display cabinet. However, the use of such multiple-glazing units turns out not to be completely satisfactory from a thermal standpoint.

Several solutions have been envisaged for further improving the thermal insulation performance of these multiple-glazing units, such as, for example, the use of thin films which reflect the infrared radiation or else the use of triple-glazing units, one of the gas layers of which may be a krypton layer. However, the improvement generally remains modest and the use of such multiple-glazing units, because of their thickness and their weight, requires a support frame which provides them with good mechanical integrity, but which makes them particularly bulky.

French Patent Application filed in the name of Saint-Gobain Vitrage under the number FR97/09772 proposes a door or wall for an environmental chamber which obviates the various drawbacks mentioned above. It thus proposes a door or wall for an environmental chamber consisting essentially of an insulating panel composed of at least two glass substrates between which a vacuum has been created, which substrates are separated from each other by mounts distributed over the entire surface and are joined together around their periphery by an inorganic seal. In this way, conventional insulating glazing units are therefore substituted with an insulating glazing unit consisting of at least two glass sheets between which a vacuum has been created, which we will hereafter call an insulating vacuum glazing unit. This type of insulating vacuum glazing unit has, for a markedly smaller total thickness than that of conventional insulating glazing units, markedly improved thermal insulation properties.

The structure of such an insulating vacuum glazing unit has the advantage of providing it with strength and integrity that are equivalent to those of a monolithic glazing unit having a thickness equal to the sum of the thicknesses of glass sheets, that is to say the glass sheets behave as a single sheet whose thickness is the sum of those of the two glass sheets. In this way, it is no longer necessary to combine this type of glazing unit with a support frame. Thus, the bulkiness is greatly reduced and the unit can be fitted into the environmental chamber in an appreciably simplified manner.

However, the use of such an insulation vacuum glazing unit is not without consequences with regard to the actual structure of the environmental cabinet, particularly when it is a cabinet in which the internal ambient temperature is greatly different from the external ambient temperature. In fact, because of the presence of the vacuum between the two glass sheets, there is a difference in expansion between the two glass sheets which results in the appearance of a bowing deformation of the glazing unit. The inventors have illustrated that the presence of such a bowing deformation of the glazing unit prevents the usual cabinet structures from being used, particularly for sealing reasons. Moreover, the fact that the use of a vacuum glazing unit makes it possible to dispense with the support frame, it has proved opportune to modify the structure of environmental cabinets so as to reduce the overall number of components and in this way to simplify assembly and to reduce the manufacturing costs of the cabinets.

SUMMARY OF THE INVENTION

The object of the invention is to produce an environmental cabinet which obviates the various drawbacks mentioned above, meets the sealing criteria for these types of cabinet and provides an easily implementable and economically advantageous construction.

The invention thus provides an environmental cabinet comprising at least two opening leaves which consist of an insulating glazing unit composed of at least two glass sheets between which a vacuum has been created, the said sheets being joined together around their periphery by an inorganic seal, the sealing between the two opening leaves being achieved by means of a vertical member which overlaps the edges of both opening leaves and is fixed to one of the edges.

In this way, compared with conventional environmental cabinets, the intermediate vertical members on which the opening leaf came into abutment so as to achieve sealing are eliminated. By virtue of the fact that this vertical member is fixed to one of the two opening leaves, it is possible for the opening leaves to be sealed and blocked while at the same time simplifying the structure of the cabinet and also improving its aesthetic appearance.

According to an advantageous embodiment of the invention, the said sealing vertical member is made of plastic which follows the deformation due to the bowing of the insulating glazing unit. This embodiment has the advantage of not creating resisting stresses in the deformed glazing unit and of running no risk of a break in the sealing over the entire length of the vertical member.

Preferably, the said sealing vertical member has a magnetic strip at its point of contact with the edge of the adjacent opening leaf. Thus, good abutment contact between the said vertical member and the opening leaf is achieved, while at the same time hermetically sealing the said opening leaf.

According to a preferred embodiment of the invention, that part of the said sealing vertical member which comprises a magnetic strip is in the form of a bellows. In this way, when the opening leaf comes into contact with the said vertical member, the magnetic contact following the bowing deformation is further improved by virtue of the fact that the bellows also makes it possible to compensate for the deformation of the glazing unit. In addition, the presence of this part in the form of a bellows allows the sealing vertical member to follow the edge of the opening leaf and part of the space between the two opening leaves, and thus prevents dust from building up.

According to a preferred variant, of the invention, the sealing between the opening leaf and the lateral ends of the cabinet is achieved at the edge of the opening leaf by means of a seal that can deform locally in its thickness and over its width and is placed on the said lateral ends of the cabinet.

According to this same variant, in the case of an environmental cabinet comprising three doors, at least the sealing between the two lateral ends of the opening leaf, which corresponds to the independent door, and the cabinet is achieved at the edges of the opening leaf by a seal that can deform locally in its thickness and over its width and is placed, on the one hand, on a lateral part of the cabinet and, on the other hand, on an intermediate vertical member.

This is described with reference to the case of a cabinet with three doors, but should be understood as applying to any cabinet having an odd number of doors and more precisely to doors which are independent, i.e. are not associated with another door and therefore in contact, on the one hand, with a lateral part of the cabinet and, on the other hand, with an intermediate vertical member of the cabinet.

The inventors have also made provision for such a variant, i.e. the use of a seal that can deform locally in its thickness and over its width and is placed on the lateral ends of the cabinet, to be applied in the case of a cabinet having a single door.

In this way, the usual contact between the internal periphery of the opening leaf and the fixed frames of the cabinet which, because of the deformation of the glazing unit, cannot be achieved in one plane, is eliminated. Contact in one plane allows good sealing to be obtained; thus, by providing a sealed contact at the edge of the opening leaf, a contact plane is maintained. By virtue of the use of a seal that can deform locally in its thickness and over its width, the deformation of the glazing unit is compensated for by producing hermetic contact at each point on the edge of the glazing unit following the bowing deformation of the thermally stressed glazing unit.

According to a preferred embodiment of the invention, the said seal has a width greater than the maximum width of the bowing deformation of the glazing unit. In this way, whatever the temperature difference between the inside and outside of the cabinet, i.e. whatever the bowing deformation of the glazing unit, the sealing between the opening leaf and the lateral parts of the cabinet is guaranteed. The term "lateral parts" should be understood to mean the longest sides of the cabinet.

According to an advantageous variant of the invention, the said seal is made of a biocidal flexible polyvinyl chloride (PVC) or a material exhibiting similar properties.

According to an advantageous embodiment of the invention, the sealing between the opening leaf and the upper and lower edges of the cabinet is achieved by means of compressible magnetic seals placed on the said edges of the cabinet so that contact is achieved around the periphery of the opening leaf.

In this way, the internal surface of the opening leaf is lightened and the compressible magnetic seal allows hermetic contact that absorbs the slight deformation which can appear over this length of contact. In fact, since this length of contact is less than that at the lateral ends of the cabinet, the bowing deformation is much less and contact may be achieved around the periphery of the opening leaf without the risk of breaking the sealing.

According to an advantageous variant of the invention, the pivot pin is off-centre with respect to the plane of the said opening leaf and the pivoting element is adhesively bonded to the opening leaf.

According to a variant of the invention, the insulating glazing unit has sheets which are offset around the entire periphery of the glazing unit and a heating system is deposited on the offset region along the inorganic seal. Thus, the appearance of condensation around the rim of the glazing unit can be eliminated, the edge of the glazing unit, because of the inorganic seal which creates a thermal bridge, forming a particularly sensitive region. By virtue of the offset glass panes, this embodiment is advantageously attractive and easy to implement.

According to an advantageous embodiment of the invention, at least one of the glass sheets is covered with one or more functional layers on at least one of its faces. Such layers are, for example, low-emissivity layers or else hydrophobic layers. If a functional layer is produced on an internal face of the glazing unit, i.e. on a face subsequently in contact with the vacuum, the invention preferably provides for the said layer to the removed from around the peripheral region of the surface corresponding to the region covered by the seal; this removal can allow better adhesion of the said seal.

Preferably, the insulating glazing unit is provided on at least its edge with an adhesively bonded profile, especially made of semi-rigid plastic with at least one part having a metal overextrusion. The term "profile" should be understood to mean any type of prefabricated profile having a shape suited to the function of the said profile. Preferably, the profile is a profile made of semi-rigid plastic so as to be able to follow, without large stresses, the deformation of the glazing unit. Such a profile adhesively bonded to at least the edge of the glazing unit can fulfill various functions, such as protecting the heating system, protecting the edges of the glazing unit, fixing various elements such as hinges or handles, or else improving the aesthetic appearance of the opening leaf. In addition, the use of such a profile is advantageous for producing the intended magnetic contacts. This is because it is possible to easily produce a metal overextrusion at predetermined places.

According to a preferred embodiment of the invention, the opening leaf is fitted with a return element of the rod-spring type. Such an embodiment is particularly advantageous from an aesthetic standpoint. This is because it avoids the use of the torsion bars normally used, these bars generally being placed in the support frame because their volume is not insignificant.

These types of arrangement have many advantages. Firstly, because of the strength and mechanical integrity of the insulating glazing unit, it is not necessary to combine the insulating glazing unit with a support frame, as in the usual multiple-glazing units, which support frame significantly increases the overall volume of the opening leaves and consequently that of the cabinet.

Next, the use of an insulating vacuum glazing unit makes it possible, as explained above, to achieve better thermal insulation than the usual insulating glazing units, for a smaller thickness and a lower weight.

Moreover, the environmental cabinet according to the invention makes it possible to significantly improve the external aesthetic appearance of these cabinets. Thus, that face of the cabinet comprising the opening leaves may be almost entirely made of glass because of the absence of support frames, and it is possible to leave a small space between the opening leaves without causing a problem when opening or closing the cabinet.

The environmental cabinets according to the invention make it possible to meet the sealing criteria required for these types of cabinet and are easy to produce, this being achieved without increasing, or even by decreasing, the manufacturing costs of the cabinets.

BRIEF DESCRIPTION OF THE DRAWINGS

Further details and advantageous characteristics of the invention will emerge below from the description of an illustrative embodiment with reference to the appended figures which illustrate.

DESCRIPTIONS OF THE PREFERRED EMBODIMENT

It should first of all be pointed out that, for the sake of clarity, the proportions between the various elements in all the figures are not strictly respected.

Figure 1A:
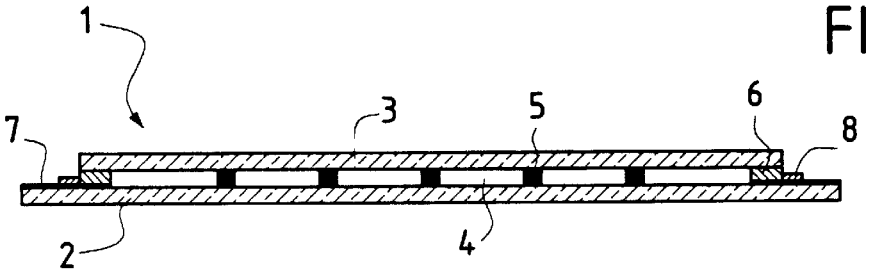
FIG. 1*a*: a horizontal section of an insulating vacuum glazing unit according to the invention.
Figure 1B:
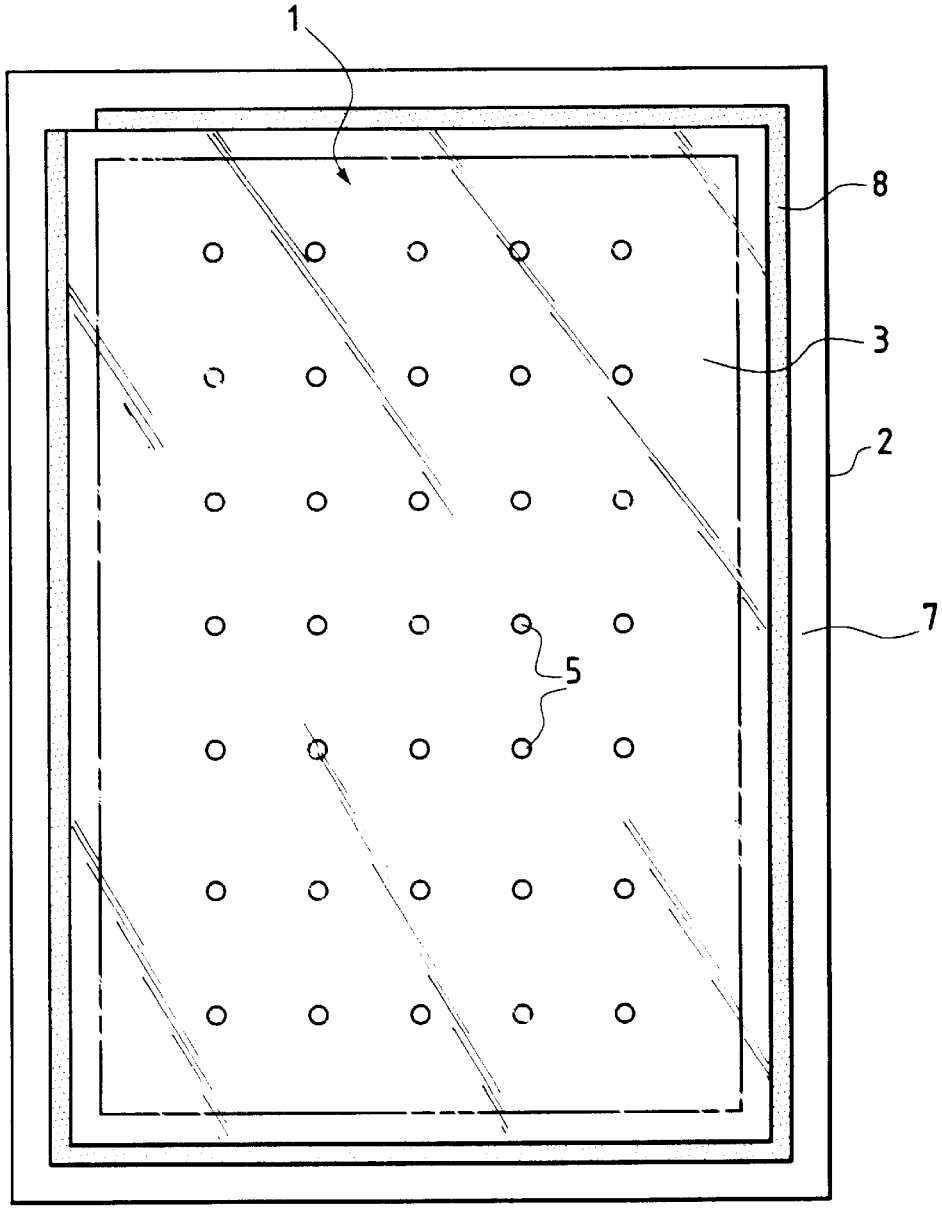
FIG. 1*b*: a front view of the glazing unit according to FIG. 1.

FIGS. 1*a* and 1*b* illustrate the insulating vacuum glazing unit 1 which will be used in an environmental cabinet according to the invention.

The insulating glazing unit 1 consists of two glass sheets 2 and 3 between which a vacuum 4 has been created, which glass sheets are separated from one another by mounts 5 distributed over the entire surface and are joined together around their periphery by an inorganic seal 6. The glass sheet 3 is smaller than the glass sheet 2 and is centred on the latter.

According to these illustrations, the glass sheet 2 is coated around the rim of its internal face with an enamel layer 7, deposited by screen printing, so that at least the inorganic seal 6 is not visible from the external side of the insulating glazing unit 1. The glass sheet 2 is also coated around the rim of its internal face along the inorganic seal 6 with a heating system 8 deposited by screen printing.

This heating system 8 is connected to an electrical circuit by any means known to those skilled in the art, and not illustrated in the figures. Preferably, this heating system 8 is a bead of silver paste 0.5 mm in width and 10 $\mu$m in thickness.

The mounts 5 have a thickness of 0.2 mm and a diameter of 0.4 mm. They are distributed over the entire surface of the glass sheets and are separated from one another by 30 mm.

Figure 2:
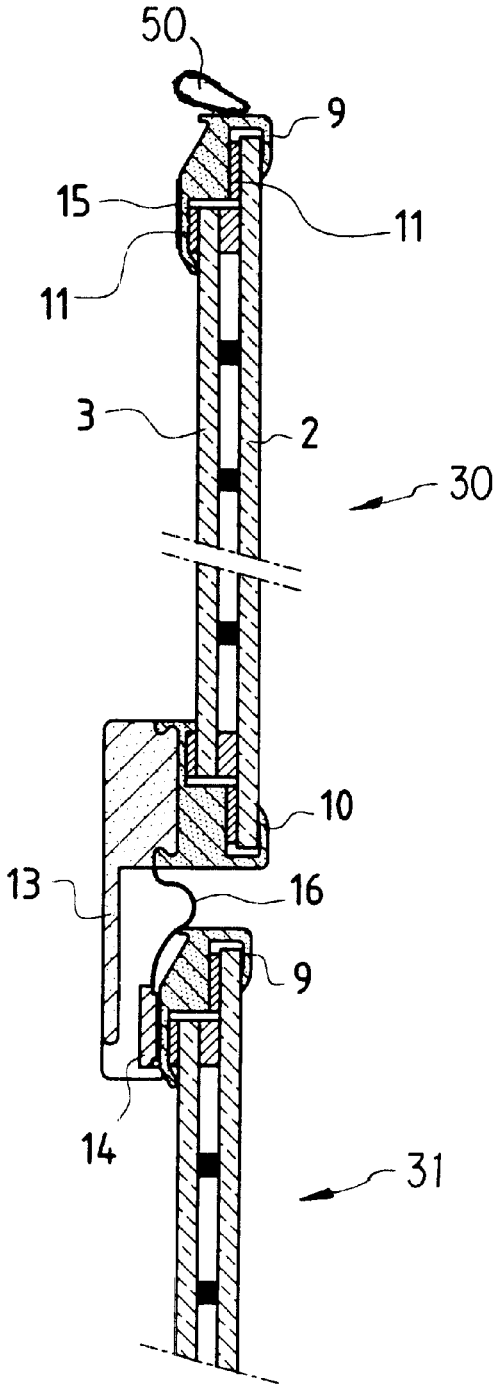
FIG. 2: a horizontal section of two adjacent opening leaves of an environmental cabinet according to the invention.

The mounts 5 are deposited on one of the glass sheets 2 and 3 after the glass sheet 2 has been coated with the layer 7 and with the heating system 8, since the glass sheets 2 and 3 have been toughened. After depositing a bead of glass frit around the periphery of the glass sheet 3, the two glass sheets 2 and 3 are assembled and then the assembly undergoes a heat treatment in order to bond the two glass sheets 2 and 3 together, the seal 6 then sealing the assembly. A vacuum is then created between the two glass sheets 2 and 3 by any means known to those skilled in the art such as, for example, the process described in French Patent Application filed in the name of Saint-Gobain Vitrage under the number FR98/01278. The FIG. 2 illustrates a horizontal section of two adjacent opening leaves 30, 31 in the closed position.

The insulating glazing unit 1 is provided around the periphery with profiles 9 and 10 made of semi-rigid plastic such as, for example, polyvinyl chloride. These profiles 9 and 10 are fixed to the insulating glazing unit 1 by means of beads of adhesive 11, so as to cover the offset region between the two glass sheets 2 and 3 and the edge of the insulating glazing unit 1. The profile 9 also allows the handle 12, illustrated in FIG. 3*b*, to be fixed.

According to this illustration, the edges of the opening leaves 30, 31 provided with the profiles 9 and 10 are overlapped by a vertical member 13 which thus makes it possible to seal this part of the cabinet and which creates a stop for these two opening leaves 30, 31. This vertical member 13 is advantageously made of plastic, such as PVC so that it follows the deformation of the insulating glazing unit 1 without creating stresses.

Advantageously, this vertical member 13 is fixed to one of the opening leaves 30, 31 by fitting it into and adhesively bonding it to the profile 10. That part of the vertical member 13 coming into contact with the profile 9 has a magnetic strip 14 and the profile 9 has a metal overextrusion 15 at this contact. In this way, the contact between these two elements 9 and 13 is hermetic. Preferably, that part of the vertical member 13 which has the magnetic strip 14 is made in the form of a bellows 16. This bellows 16 thus makes it possible to improve the sealing at this contact by compensating for the bowing deformation of the insulating glazing unit 1 in addition to the fact that the vertical member 13 already follows the deformation of the insulating glazing unit 1.

Figure 3A:
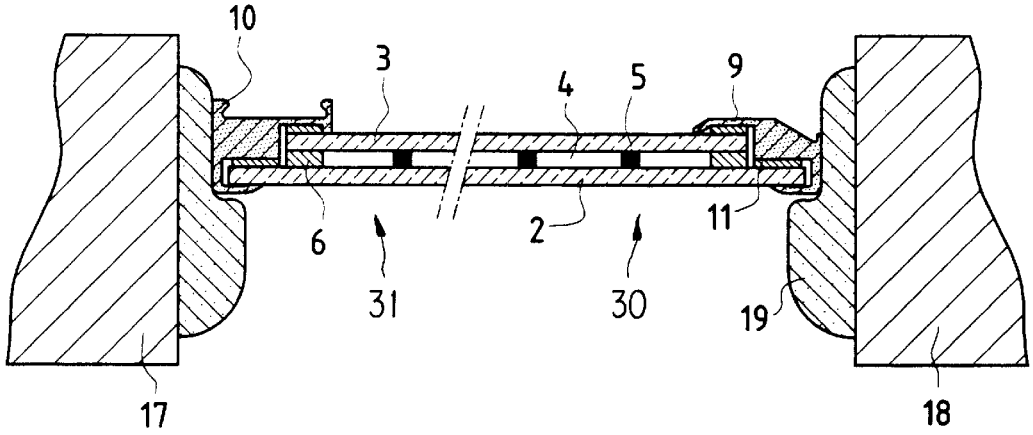
FIG. 3*a*: a horizontal section of the lower part comprising the opening leaves of an environmental cabinet according to the invention.
Figure 3B:
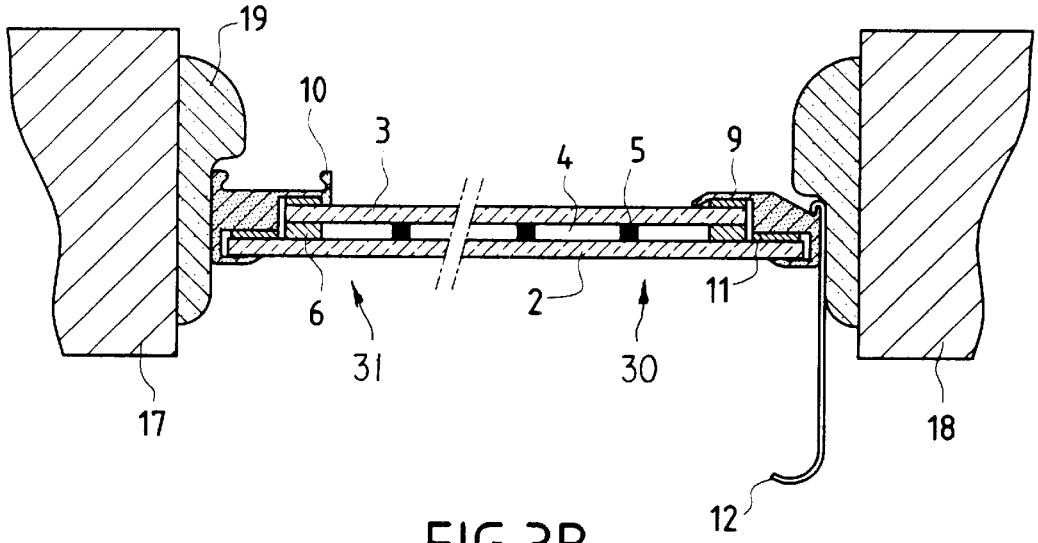
FIG. 3*b*: a horizontal section of the central part comprising the opening leaves of an environmental cabinet according to the invention.

FIGS. 3*a* and 3*b* illustrate respectively a horizontal section of the lower part and a horizontal section of the central part comprising the opening leaves 30, 31 in the closed position of an environmental cabinet according to the invention.

The lateral ends of the environmental cabinet according to the invention are depicted by 17 and 18. At each of these ends 17 arid 18 there is a seal 19 that can deform locally in its thickness and over its width. FIGS. 3*a* and 3*b* allow the advantage of such a seal 19 to be understood. This is because the difference in position of the opening leaves 30, 31 between the bottom part and the top part of the latter is due to the bowing deformation of the insulating glazing unit 1 when the latter is under thermal stress. Thus, the seal 19 seals over the entire height of the opening leaves 30, 31.

Advantageously, it does not matter whether the profiles 9 and 10 are positioned on central opening leaves of the cabinet or on lateral opening leaves, even if the particular shape of these profiles is not always essential. For example, the profile 10 has a fitting region provided for fixing the vertical member 13. This region is, for example, unnecessary when this part of the opening leaf is positioned at one end of the cabinet. However, it has proved to be more profitable and simpler to produce opening leaves all having the same structure rather than providing opening leaves whose structure depends on their positions in the cabinet.

Figure 4:
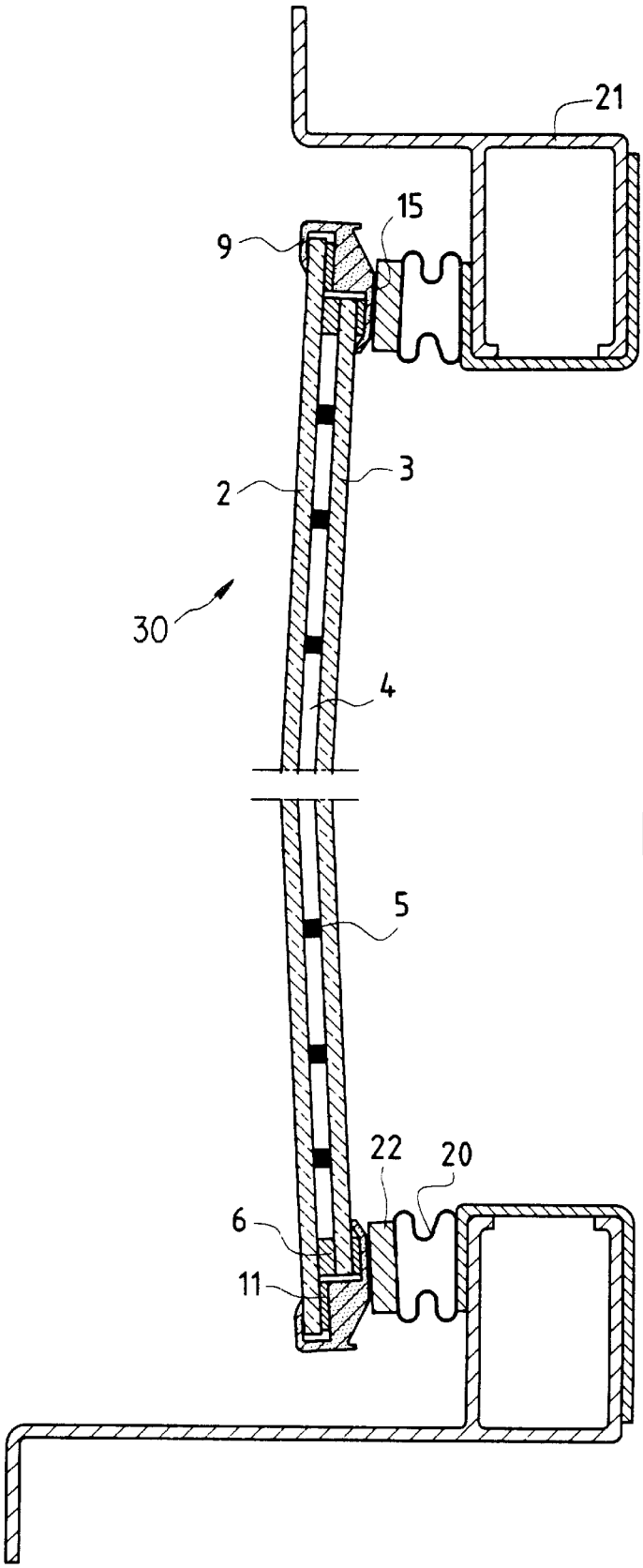
FIG. 4: a vertical section of an opening leaf of an environmental cabinet according to the invention.

FIG. 4 illustrates a vertical section of an opening leaf 30 in the closed position of an environmental cabinet according to the invention.

In this illustration, the insulating glazing unit 1 is under thermal stress, as explained by its slightly bowed shape, the temperature inside the cabinet being below the outside temperature. The insulating glazing unit 1 is provided around the periphery with the profiles 9 described above. These profiles 9 come into contact with seals 20 adhesively bonded to the cabinet 21. These seals 20 are compressible in their thickness and have a magnetic strip 22 which faces the metal overextrusion 15 of the profile 9.

In FIG. 2, Reference Numeral 50 shows a pivot pin provided off-center with respect to the plane of the opening leaf 30, forming a pivoting element or a return element of the rod-spring type.

This type of environmental cabinet thus described is easy to produce and to fit since it does not need an enormous number of components. It provides a questionable thermal insulation as well as very good sealing, while being particularly attractive.

The invention is not limited to this particular type of embodiment and must be interpreted in a non-limiting manner and encompassing any type of environmental cabinet comprising at least two opening leaves which consist of an insulating glazing unit composed of at least two glass sheets between which a vacuum has been created, the said sheets being joined together around their periphery by an inorganic seal, the sealing between the two opening leaves being achieved by means of a vertical member which overlaps the edges of both opening leaves and is fixed to one of the edges.

What is claimed is:

1. An environmental cabinet comprising:

at least two opening leaves each including an insulating glazing unit having at least two glass sheets between which a vacuum has been created, said at least two sheets being joined together at periphery by an inorganic seal; and a vertical member overlapping edges of said at least two opening leaves and fixed to one of the edges of said at least two opening leaves;

wherein the at least two opening leaves and lateral ends of the environmental cabinet are sealed by a seal configured to deform locally in thickness and over width and placed on the lateral ends of the environmental cabinet.

2. An environmental cabinet according to claim 1, wherein said vertical member comprises a plastic capable of following deformation due to bowing of the insulating glazing unit.

3. An environmental cabinet according to claim 1, wherein said vertical member has a magnetic strip at a point of contact with other one of the edges of the at least two opening leaves.

4. An environmental cabinet according to claim 1, wherein the vertical member includes a bellows configured to support the magnetic strip.

5. An environmental cabinet according to claim 1, wherein said seal has a width greater than a maximum width of bowing deformation of the insulating glazing unit.

6. An environmental cabinet according to claim 1, wherein said seal comprises a biocidal flexible polyvinyl chloride.

7. An environmental cabinet according to claim 1, wherein the at least two opening leaves and upper and lower edges of the environmental cabinet is sealed by compressible magnetic seals placed on the upper and lower edges of the environmental cabinet.

8. An environmental cabinet according to claim 1, wherein the opening leaf includes a pivot pin provided off-center with respect to a plane of the opening leaf and a pivoting element adhesively bonded thereto.

9. An environmental cabinet according to claim 1, wherein the at least two glass sheets are offset around an entire periphery and includes a heating system deposited on an offset portion along the inorganic seal.

10. An environmental cabinet according to claim 1, wherein one of the at least two glass sheets of the insulating glazing unit is covered with at least one functional layer on at least one face of the one of the at least two glass sheets.

11. An environmental cabinet according to claim 1, wherein the insulating glazing unit is provided with an adhesively bonded profile on at least one edge portion.

12. An environmental cabinet according to claim 11, wherein the adhesively bonded profile comprises a semi-rigid plastic with at least one part having a metal overextrusion.

13. An environmental cabinet according to claim 1, wherein the opening leaf is fitted with a return element of a rod-spring type.

14. An environmental cabinet according to claim 1, wherein the at least two opening leaves and upper and lower edges of the environmental cabinet is sealed by compressible magnetic seals placed on the upper and lower edges of the environmental cabinet.

15. An environmental cabinet comprising:

at least two opening leaves each including an insulating glazing unit having at least two glass sheets between which a vacuum has been created, said at least two sheets being joined together at periphery by an inorganic seal; and a vertical member overlapping edges of said at least two opening leaves and fixed to one of the edges of said at least two opening leaves;

wherein when the at least two opening leaves comprise an odd number of doors, sealing between two lateral ends of an opening leaf of the at least two opening leaves corresponding to an independent door and the environmental cabinet is sealed by a seal configured to deform locally in thickness and over width and placed on a lateral part of the environmental cabinet and an intermediate vertical member.

* * * * *